US008931524B2

(12) United States Patent
Morii et al.

(10) Patent No.: US 8,931,524 B2
(45) Date of Patent: Jan. 13, 2015

(54) FLUID TRANSFERER, FLUID FILLING APPARATUS AND FLUID TRANSFER METHOD

(75) Inventors: Kazuyoshi Morii, Shizuoka (JP); Tatsushi Umayahara, Shizuoka (JP); Yusuke Uchida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 322 days.

(21) Appl. No.: 13/440,034

(22) Filed: Apr. 5, 2012

(65) Prior Publication Data

US 2012/0285540 A1 Nov. 15, 2012

(30) Foreign Application Priority Data

May 9, 2011 (JP) ..... 2011-104617

(51) Int. Cl.
*B65B 1/10* (2006.01)
*B65B 1/38* (2006.01)
*G03G 15/08* (2006.01)

(52) U.S. Cl.
CPC ..... *G03G 15/0879* (2013.01); *B65B 1/10* (2013.01); *B65B 1/38* (2013.01); *G03G 15/0832* (2013.01)
USPC ..... 141/25; 141/2; 399/258

(58) Field of Classification Search
CPC ..... B65B 1/10; B65B 1/38; G03G 15/0832
USPC ..... 141/2, 18, 25; 399/258
See application file for complete search history.

(56) References Cited

U.S. PATENT DOCUMENTS

| | | | | |
|---|---|---|---|---|
| 4,760,425 | A * | 7/1988 | Okano et al. | 399/142 |
| 4,840,205 | A * | 6/1989 | Drevfors et al. | 141/2 |
| 4,869,397 | A * | 9/1989 | Corniea et al. | 222/63 |
| 5,785,491 | A * | 7/1998 | Ozawa et al. | 415/70 |
| 5,855,232 | A * | 1/1999 | Oda et al. | 141/83 |
| 6,568,536 | B2 | 5/2003 | Tanaka et al. | |
| 6,679,301 | B2 * | 1/2004 | Makino et al. | 141/67 |
| 6,859,634 | B2 * | 2/2005 | Itoh et al. | 399/258 |
| 7,043,179 | B2 * | 5/2006 | Matsumoto et al. | 399/258 |
| 7,333,756 | B2 * | 2/2008 | Schoch et al. | 399/258 |
| 8,151,829 | B2 * | 4/2012 | Makino | 141/65 |
| 2002/0144746 | A1 * | 10/2002 | Makino et al. | 141/12 |
| 2005/0025527 | A1 * | 2/2005 | Matsumoto et al. | 399/258 |
| 2007/0122204 | A1 * | 5/2007 | Kita | 399/258 |
| 2009/0010685 | A1 | 1/2009 | Makino | |
| 2013/0266345 | A1 * | 10/2013 | Matsumoto et al. | 399/258 |

FOREIGN PATENT DOCUMENTS

| | | |
|---|---|---|
| CN | 100520627 | 7/2009 |
| JP | 2005-75374 | 3/2005 |
| JP | 2007-25625 | 2/2007 |
| JP | 2008-75534 | 3/2008 |
| JP | 4274537 | 6/2009 |
| JP | 2010/274940 | 12/2010 |

OTHER PUBLICATIONS

Chinese official action dated Sep. 30, 2013 in corresponding Chinese patent application No. 201210141350.0.

* cited by examiner

*Primary Examiner* — Nicholas A Arnett
(74) *Attorney, Agent, or Firm* — Cooper & Dunham LLP

(57) ABSTRACT

A fluid transferer, including a volume changing part; a reciprocating member configured to reciprocate to expand a volume of the volume changing part to draw a fluid from an upstream side of a transfer direction and compress the volume thereof to transfer the drawn fluid to a downstream side thereof with pressure; and a drive controller configured to control reciprocation of the reciprocating member such that a time for compressing the volume of the volume changing part is longer than a time for expanding the volume thereof.

11 Claims, 6 Drawing Sheets

FLUID TRANSFERER, FLUID FILLING APPARATUS AND FLUID TRANSFER METHOD

CROSS-REFERENCE TO RELATED APPLICATIONS

This patent application is based on and claims priority pursuant to 35 U.S.C. §119 to Japanese Patent Application No. 2011-104617, filed on May 9, 2011, in the Japanese Patent Office, the entire disclosure of which is hereby incorporated herein by reference.

FIELD OF THE INVENTION

The present invention relates to a fluid transferer transferring a material having fluidity such as a powder, a fluid filling apparatus having the fluid transferer, and to a method of transferring a fluid.

BACKGROUND OF THE INVENTION

Conventionally, a toner used in electrophotographic image formation is filled in a toner container by a toner filling apparatus, and the toner container is set in an image forming apparatus. In a toner filling apparatus, as a toner transfer apparatus transferring a toner from a toner basket including a toner for filling to the toner container, an auger method rotating a spiral transfer member is known. However, in a toner transfer apparatus using an auger method, the toner receives a stress from friction with the rotating transfer member and possibly deteriorates in quality.

Japanese Patent No. 4335216 discloses a toner transferer feeding air to a toner in a toner basket to have higher fluidity and transferring the toner to a toner container by a reciprocating pump. The reciprocating pump includes a volume changing part changing its volume when a reciprocating member reciprocates. The reciprocating pump expands a volume of the volume changing part to introduce the toner from the toner basket and compresses the volume thereof to transfer the introduced toner to the toner container with pressure. Therefore, the reciprocating pump prevents a toner from deteriorating due to friction with the transfer member in the auger method.

However, a toner filling apparatus using a conventional reciprocating pump has a problem of large unevenness in amounts of toner filled in a toner container. This has the following reasons. The reciprocating pump does not quickly stop transferring toner when tuned off and transfers a small amount thereof. Therefore, the toner filling apparatus using the reciprocating pump includes a weigher weighing the toner container and stops the reciprocating pump when weighing a weight a little lighter than a weight of the toner container filled with a desired amount of toner.

A conventional reciprocating pump, when a period in which the completely compressed volume changing part is expanded and completely compressed again is one cycle, has the same time for expanding and compressing the volume of the volume changing part in one cycle of the reciprocation. The toner is fed to the toner container only when the volume changing part is compressed, and this is why a time for transferring the toner to the toner container is not longer than a half of the cycle. Thinking of a transfer amount of the toner per time more shortly divided from one cyclic time, when a time for transferring the toner to the toner container is not longer than a half of the cycle, a peak value of the transfer amount of the toner is larger than an average thereof during the cycle.

The conventional reciprocating pump has large unevenness of the amount of a toner fed after turned off according to timing of being turned off during the cycle. Specifically, when the pump is turned off just before the transfer amount of the toner has a peak value, the toner in an amount of the peak value is fed and comparatively a large amount of the toner is filled in the toner container. Meanwhile, when the pump is turned off while or just before expanding the volume of the volume changing part, almost no toner is fed after the pump is turned off. Thus, comparatively a large amount of the toner is filled in the toner container or almost no toner is fed after the pump is turned off, and amounts of the toner filled in the toner container have large unevenness after the filling process.

In order to prevent the unevenness of the amount of a toner filled in the toner container, a toner transferring apparatus using reciprocation and having a small difference between the peak value of the transfer amount of the toner and an average thereof during the cycle is required.

Further, when the peak value of the transfer amount of the toner is smaller than the average thereof during the cycle, stresses on the toner and each member forming the toner transferring apparatus can be decreased. The objects of preventing unevenness of filling amount in a filling apparatus and stresses on a fluid and each member forming a transferring apparatus are not limited to a toner transferring apparatus. Therefore, not only the toner transferring apparatus but also apparatuses transferring other fluids such as powders, liquids and gases besides a toner preferably have a small difference between a peak value of transfer amount and an average thereof during a cycle.

Because of these reasons, a need exists for a fluid transferer transferring a fluid using reciprocation and preventing an difference between an average of a transfer amount of the fluid and a peak value thereof during a cycle of the reciprocation.

SUMMARY OF THE INVENTION

Accordingly, one object of the present invention to provide a fluid transferer transferring a fluid using reciprocation and preventing an difference between an average of a transfer amount of the fluid and a peak value thereof during a cycle of the reciprocation.

Another object of the present invention to provide a fluid filling apparatus using the fluid transferer.

A further object of the present invention to provide a method of transferring fluids.

These objects and other objects of the present invention, either individually or collectively, have been satisfied by the discovery of a fluid transferer, comprising:

a volume changing part;

a reciprocating member configured to reciprocate to expand a volume of the volume changing part to draw a fluid from an upstream side of a transfer direction and compress the volume thereof to transfer the drawn fluid to a downstream side thereof with pressure; and a drive controller configured to control reciprocation of the reciprocating member such that a time for compressing the volume of the volume changing part is longer than a time for expanding the volume thereof.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a fluid transferer transferring a fluid using reciprocation and preventing an difference between an average of a transfer amount of the fluid and a peak value thereof during a cycle of the reciprocation.

More particularly, the present invention relates to a fluid transferer, comprising:

a volume changing part;

a reciprocating member configured to reciprocate to expand a volume of the volume changing part to draw a fluid from an upstream side of a transfer direction and compress the volume thereof to transfer the drawn fluid to a downstream side thereof with pressure; and a drive controller configured to control reciprocation of the reciprocating member such that a time for compressing the volume of the volume changing part is longer than a time for expanding the volume thereof.

Hereinafter, an embodiment of a bellows pump 100 as the fluid transferer of the present invention is explained.

Figure 1:
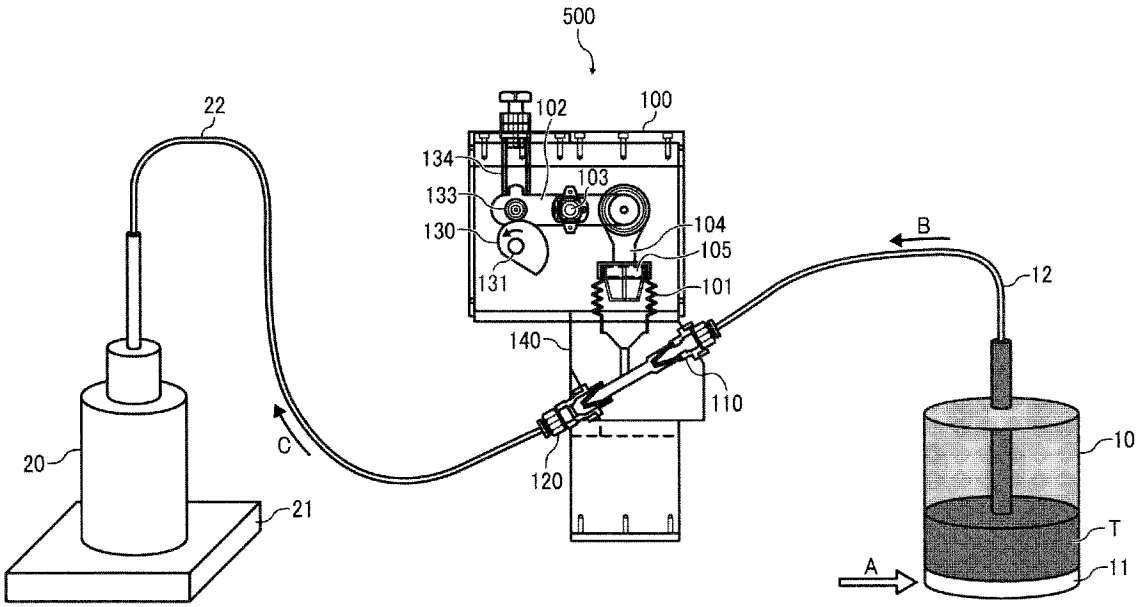
FIG. 1 is a schematic view illustrating the toner filling apparatus of the present invention.

FIG. 1 is a schematic view illustrating the toner filling apparatus 500 including a bellows pump 100 of the present invention. The toner filling apparatus 500 feeds air from the bottom of a toner basket 10 storing a toner T in the direction of an arrow A to fluidize the toner T, and fills a toner container 20 with the fluidized toner T in a specific amount by the bellows pump 100.

Figure 2B:
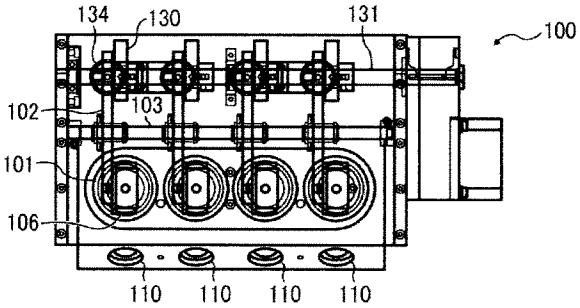
FIGS. 2A, 2B and 2C are schematic front, top and side views, respectively, illustrating the bellows pump of the present invention.
Figure 2C:
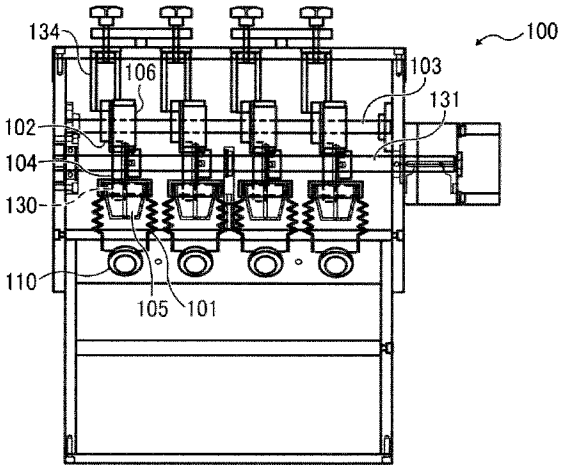
Figure 2A:
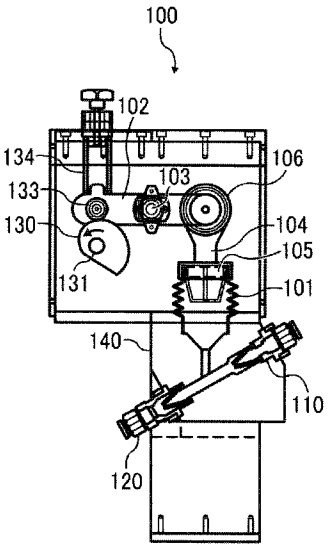

FIGS. 2A, 2B and 2C are schematic front, top and side views, respectively, illustrating the bellows pump 100 included in the toner filling apparatus 500.

The toner basket 10 forms a toner fluidizing part taking air in from the basket bottom 11 to fluidize the toner T stored therein. The bellows pump 100 compresses and expands bellows 101 screwed into a valve block 140 to transfer the toner T from the toner basket 10 in one direction to the toner container 20 through two duckbill valves 110 and 120. A weigher 21 weighing the toner T filled in the toner container 20 is located at a position where the toner container 20 is placed to form a toner weigher.

The toner basket 10 has a filter having openings smaller than a particle diameter of the toner T at the basket bottom 11, through which air is fed thereto to fluidize the toner.

The bellows pump 100 draws the fluidized toner T from the toner basket 10 in the direction of an arrow B in FIG. 1, and transfers the toner T to the toner container 20 in the direction of an arrow C.

The toner weigher weighs the toner transferred to the toner container 20 by the weigher 21. Based on the weighing result, an unillustrated controller stops the bellows pump 100 to fill the toner container 20 with a predetermined amount of the toner T.

The bellows pump 100 includes two duckbill valves as check valves to transfer the toner T in one direction, i.e., the first duckbill valve 110 at a drawing side and the second duckbill valve 120 at a discharge side, and expands and compresses the bellows 101 to draw and discharge.

A cam 130 is located on a cam shaft 131 as a rotational shaft, and a lever 102 having a cam follower 133 driven by the cam 130 transmits a vertical reciprocation to a coupling rod 104 to rise and fall to expand and compress the bellows 101. An end of a side the cam follower 133 of the lever 102 is located on is pressed downward by a compression spring 134, and the cam follower 133 constantly contacts a circumferential surface of the cam 130. The toner filling apparatus 500 rotates the cam shaft 131 by an unillustrated driver such as a motor to fill and stops rotating the cam shaft 131 to stop filling.

The cam follower 133 is fixed on an end of the lever 102 in its longitudinal direction, and the coupling rod 104 is connected to the other end thereof to connect the bellows 101 therewith. A reciprocating member 105 of the bellows 101 is fixed at a lower end of the coupling rod 104, and an upper end thereof is turnably connected with the lever 102 by a turnable connection member 106. The lever 102 is turnable around a lever turning axis 103, and the coupling rod 104 transmits turning motion of the lever 102 to the reciprocating member 105 as a vertical reciprocation.

The bellows 101 has a structure of an accordion tube on which the reciprocating member 105 is fixed. When the reciprocating member 105 descends, the accordion tube contracts and its inner volume contracts to perform compression. When the reciprocating member 105 ascends, the accordion tube expands and its inner volume expands to perform expansion.

The cam 130 rotates to change a distance from a center of the cam shaft 131 to a point on the circumferential surface of the cam 130 where the cam follower 133 contacts to. When the distance increases, the cam follower 133 is pushed up relative to the cam shaft 131, and the reciprocating member 105 connected with an end of the lever 102 through the coupling rod 104 across the lever turning axis 103 is pushed down and descends. When the distance decreases, an end of the lever 102 at its side where the cam follower is located is pushed down by the compression spring 134, and the reciprocating member 105 ascends.

When the cam 130 rotates to increase the distance from a center of the cam shaft 131 to a point on the circumferential surface of the cam 130 where the cam follower 133 contacts to, the reciprocating member 105 descends to compress the bellows 101. The pressure of a space of the valve block 140 connected with the bellows 101 while screwed thereinto increases. Then, an end of the first duckbill valve 110 at drawing side is blocked and a pipeline with a drawing side transfer pipe 12 is closed. Then, an end of the second duckbill valve 120 at discharge side is pushed outward to open, and the toner T in the bellows 101 is discharged to a discharge side transfer pipe 22.

When the cam 130 rotates to decrease the distance from a center of the cam shaft 131 to a point on the circumferential surface of the cam 130 where the cam follower 133 contacts to, the reciprocating member 105 ascends and the bellows 101 expands to depress the space of the valve block 140. Then, an end of the second duckbill valve 120 at discharge side is drawn inside to be closed, and the toner T is drawn into the bellows 101 from a pipeline from the drawing side transfer pipe 12.

In order to precisely fill the toner container 20 with a toner, a discharge speed variation in a compressional process of the bellows pump 100 is required to be small to improve filling preciseness of the toner filling apparatus 500. Further, in order to prevent deterioration of a toner, it is required that a stress to the toner when filled by the toner filling apparatus 500 is prevented.

As mentioned above, the toner filling apparatus 500 of the present invention has a means of mixing a gas in the toner T as a powder to be fluidized and uses the bellows pump 100 having check valves such as duckbill valves at a drawing and a discharge side. Then, the toner T filled in the toner container 20 is weighed and the bellows pump 100 is stopped to fill the toner container 20 with the toner T in a specific amount.

Further, in the toner filling apparatus 500, the cam 130 transmitting reciprocation to the bellows 101 of the bellows pump 100 has a shape such that a rotational angle of the cam 130 includes an angle allocated to a compressional operation of the bellows 101 (compression side angle) larger than an angle allocated to an expansional movement (expansion side angle), and that the compressional speed is constant.

Figure 3:
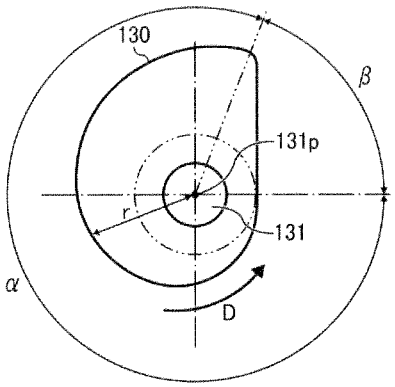
FIG. 3 is an enlarged view illustrating a cam included in the bellows pump of the present invention.

The cam 130 of the bellows pump 100 is explained. FIG. 3 is an enlarged view illustrating the cam 130.

When the bellows pump 100 drives, the cam shaft 131 rotates to rotate the cam 130 anticlockwise in the direction of an arrow D in FIG. 3. While the cam follower 133 contacts a circumferential surface of an area of an angle α in FIG. 3, a distance r from a center 131*p* of the cam shaft 131 to the point on the circumferential surface of the cam 130 where the cam follower 133 contacts to increases. Hereinafter, the angle α is referred to as a compression side allocated angle α. When the cam 130 rotates, while the cam follower 133 contacts a circumferential surface of an area of an angle β in FIG. 3, the distance r from the center 131*p* of the cam shaft 131 to the point on the circumferential surface of the cam 130 where the cam follower 133 contacts to decreases. Hereinafter, the angle β is referred to as an expansion side allocated angle β.

As FIG. 3 shows, the cam 130 has the compression side allocated angle α fully larger than the expansion side allocated angle β. When the cam 130 rotates in the direction of an arrow D, while the cam follower 133 contacts the circumferential surface at the compression side angle α, the distance r increases approximately in proportion to a rotational speed. Since the distance r increases approximately in proportion to the rotational speed, when the cam 130 rotates at a constant speed, while the cam follower 133 contacts the circumferential surface at the compression side angle α, the distance r increases approximately at a constant speed. Thus, the cam follower 133 ascends at a constant speed, the reciprocating member 105 descends at a constant speed through the lever 102, and a volume of the bellows 101 decreases at a constant speed. As a result, in the compressional operation, the toner T in the bellows 101 is discharged to the discharge side transfer pipe 22 at a constant speed.

Toner transfer methods using conventional toner filling apparatuses are explained. Specific examples thereof include auger methods, tube methods, fluid pressure methods, fluid drop methods, bellows pump methods, etc.

Particularly, the fluid pressure methods, the fluid drop methods and the bellows pump methods are known to increase fluidity of a toner to make it easy to transfer the toner and prevent stress thereto.

Japanese Patent No. 4335216 discloses a toner filling apparatus including a toner drawing means formed of a bellows pump as a reciprocation pump and an air feeder to a powdery toner. The toner filling apparatus feeds air in a toner basket including the powdery toner to be fluidized and draws the fluidized toner by the bellows pump to transfer the powdery toner from the toner basket to a toner container. The bellows pump prevents stress to the powdery toner when transferred. The toner filling apparatus disclosed in Japanese Patent No. 4335216 is similar to the toner filling apparatus 500 in that a bellows pump is used as a toner transfer apparatus. However, a conventional bellows pump has large pulsation, and when a specific amount of a toner is filled in a toner container such as a toner bottle, the amount of the toner filled in the toner container largely varies according to timing of stopping the bellows pump.

Japanese published unexamined application No. 2008-075534 uses a lead screw to transmit reciprocation to a bellows, and rotates a drive motor forward and reverse to elongate and contract the bellows to transfer a fluid. The lead screw is capable of elongating and contracting the bellows at a constant speed to discharge a toner at a constant speed. However, when the drive motor is rotated forward and reverse at the same speed, the amount of the toner filled largely varies according to timing of stopping the bellows pump as well.

Figure 4A:
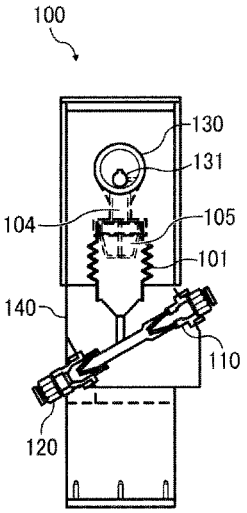
FIGS. 4A and 4B are schematic front and side views, respectively, illustrating a conventional bellows pump.
Figure 4B:
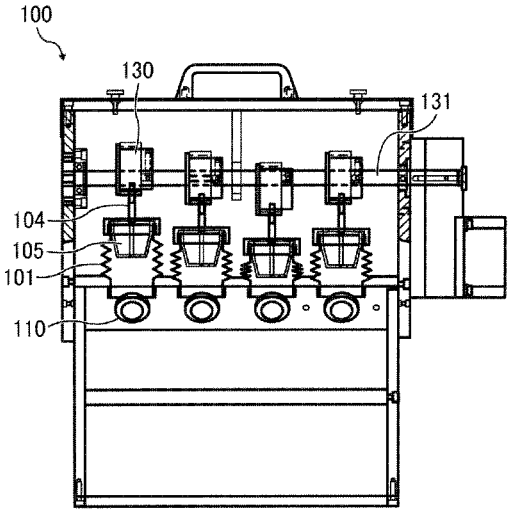
Figure 5:
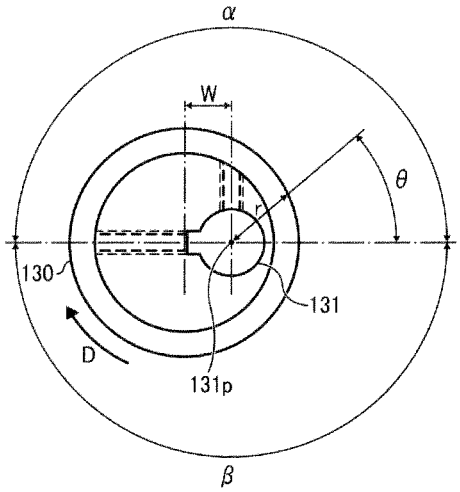
FIG. 5 is an enlarged view illustrating a cam included in the conventional bellows pump.

FIGS. 4A and 4B are schematic front and side views, respectively, illustrating a conventional bellows pump 100. FIG. 5 is an enlarged view illustrating a cam 130 included in the conventional bellows pump 100.

The conventional bellows pump 100 uses an eccentric cam as the cam 130 compressing and expanding the bellows 101 as FIGS. 4 and 5 show. The eccentric cam is a circular disc having cam shaft penetrating though a point far from a center thereof by an eccentric amount W.

In the conventional bellows pump 100 in FIG. 4, an upper end of the coupling rod 104 is the cam follower 133, and the eccentric cam directly transmits vertical reciprocation to the coupling rod 104. The eccentric cam has the shape of a bilateral circle. Therefore, a ratio of a compression side allocated angle α increasing a distance r from a center 131*p* to a point on the circumferential surface of the cam 130 where the cam follower 133 contacts to and an expansion side allocated angle β decreasing the distance r is 1/1.

A relation between the distance r and a rotational angle θ is approximately a single chord curve having the following formula:

$$r=R_0-W\cos\theta$$

wherein $R_0$ is a radius of the circular disc and W is an eccentric amount.

Compared FIG. 3 with FIG. 5, the conventional cam 130 in FIG. 5 has a compression side allocated angle α and an expansion side allocated angle β equal to each other, and the cam 130 of the present invention in FIG. 3 has a compression side allocated angle α fully larger.

Therefore, when the cam 130 has the same rotational speed, while the cam 130 rotates one time, a time for the cam follower 133 contacts a circumferential surface of the cam 130 of the present invention at the compression side allocated angle α is longer than that of the conventional cam 130. A discharge peak amount per unit time which is a shorter divisional time from a time for the cam 130 to rotate one time can be smaller than an average per unit time while the cam 130 rotates one time.

The discharge peak amount is limited to perform discharge operation more stable than the conventional bellows pump does.

In the bellows pump 100 in FIG. 2, the cam 130 elongating and contracting the bellows 101 has the shape in which a compression side is allocated longer than an expansion side. Therefore, one cyclic time of reciprocation is the same, and when a toner transfer amount per one cyclic time of reciprocation is the same, a compression speed can be lowered than when the conventional eccentric cam is used and the discharge amount of the toner T fed by the compression of the bellows 101 per unit time can be reduced. Further, the compression speed is approximately constant. When the unillustrated cam shaft drive motor for the bellows pump 100 is stopped when a desired amount of the toner is being filled, an amount of the toner T fed until filling the toner T is stopped varies less. Therefore, an amount thereof filled in the toner container 20 has less unevenness. Further, a stress to the toner T is reduced more than when the eccentric cam is used because of the lower compression speed.

As FIG. 2 shows, the multiply-located bellows 101 of the bellows pump 100 increases a transfer amount per time and averages a discharge amount per time. An unillustrated cam shaft drive motor drives the cam shaft 131 and plural (four in this embodiment) cams 130 are located on the cam shaft 131. The cams 130 are located at a phase difference when 360[°] is divided by the number thereof (four in this embodiment).

Figure 6:
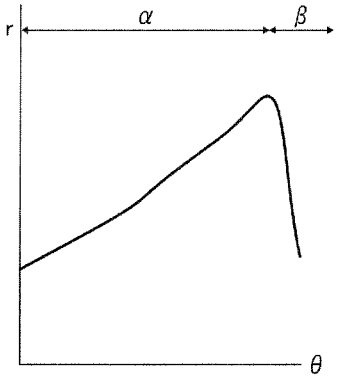
FIG. 6 is a cam diagram of the cam included in the bellows pump of the present invention.

FIG. 6 is a cam diagram showing a relationship between a rotational angle θ and a distance r to an outer circumference of the cam 130 included in the bellows pump 100 of the present invention.

When the rotational angle θ is within the compression side allocated angle α, the relationship between the rotational angle θ and the distance r linearly goes up. Since the compression side allocated angle α is longer than the expansion side allocated angle β in the θ direction, a time for compression process compressing a volume of the bellows 101 is longer than that for expansion process expanding the volume thereof when the rotational speed is constant.

Figure 7:
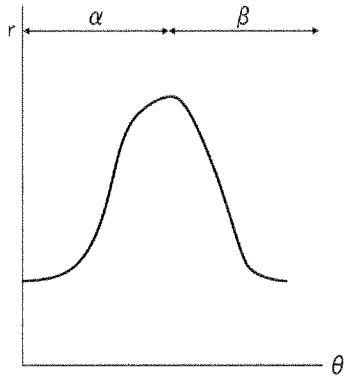
FIG. 7 is a cam diagram of the cam included in the conventional bellows pump.

FIG. 7 is a cam diagram showing a relationship between a rotational angle θ and a distance r to an outer circumference of the cam 130 included in the conventional bellows pump 100 in FIGS. 4 and 5.

As FIG. 5 shows, the cam diagram of the conventional example is approximately a single chord curve having the following formula:

$$r=R_0-W\cos\theta$$

wherein $R_0$ is a radius of the circular disc and W is an eccentric amount.

Since the compression side allocated angle α and the expansion side allocated angle β have the same length in the θ direction, a time for compression process compressing the volume of the bellows 101 and a time for expansion process expanding the volume thereof have the same length when the rotational speed is constant.

Figure 8:
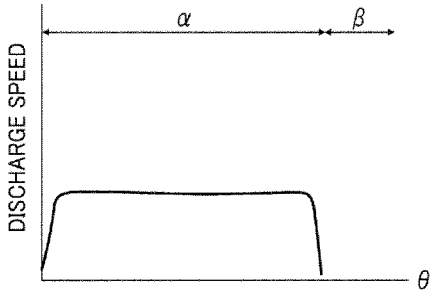
FIG. 8 is a diagram showing a relationship between a powder discharge speed and a rotational angle of the bellows pump of the present invention.

FIG. 8 is a diagram showing a relationship between a discharge speed of the toner T (hereinafter referred to as a powder discharged speed) per unit time and a rotational angle θ of the bellows pump 100 of the present invention.

In the compression process in which the cam curve linearly increases in the cam diagram, the bellows 101 decreases the volume at almost a constant speed to discharge the toner T at almost a constant speed.

In the expansion process, the second duckbill valve 120 closes a pipeline with the discharge side transfer pipe 22 only to draw the toner T.

Figure 9:
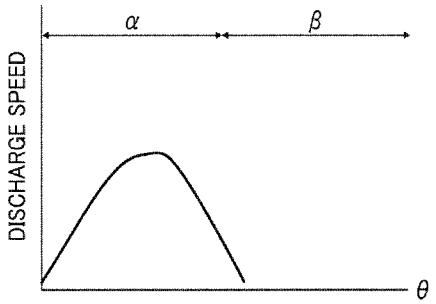
FIG. 9 is a diagram showing a relationship between a powder discharge speed and a rotational angle of the conventional bellows pump.

FIG. 9 is a diagram showing a relationship between a powder discharge speed and a rotational angle θ of the conventional bellows pump 100 in FIGS. 4 and 5.

Since the conventional bellows pump 100 is pushed down by an eccentric cam performing single chord movement, a discharge amount of the powder pushed out by contraction of the bellows pump 100 has the shape of a single chord and periodically changes. In the expansion process, the second duckbill valve 120 closes a pipeline with the discharge side transfer pipe 22 only to draw the toner T.

A time ratio of the compression process to the expansion process is 1/1, and a maximum value of the discharge speed is larger than that of the bellows pump 100 of the present invention in FIG. 8.

Therefore, the conventional bellows pump 100 has large pulsation. In contrast, the bellows pump 100 of the present invention has a peak of discharge speed lower than the conventional one and can transfer a powder with less pulsation.

When the bellows pump 100 is used to fill a toner as the toner filling apparatus 500 in FIG. 1, when an amount of the toner filled is measured by the weigher 21 to be close to a target value, it takes a time since an unillustrated cam shaft drive motor stops until toner T completely stops discharging. The conventional bellows pump 100 having uneven discharge speed according to a rotational angle θ of the cam 130 has uneven discharged toner amount since the cam shaft drive motor stops according to timing of stopping the cam shaft drive motor. On the contrary, the bellows pump 100 of the present invention having less uneven discharge speed prevents the uneven discharged toner amount since the cam shaft drive motor stops.

When compressed, the toner T increases in density and is vulnerable to stress, and a time for discharging can be prolonged and a peak of discharging speed can be lowered, which is effective for products having a low softening point.

The expansion process in which a reactive force due to compression is released can draw the toner without harming the toner even in a shorter time.

Figure 10:
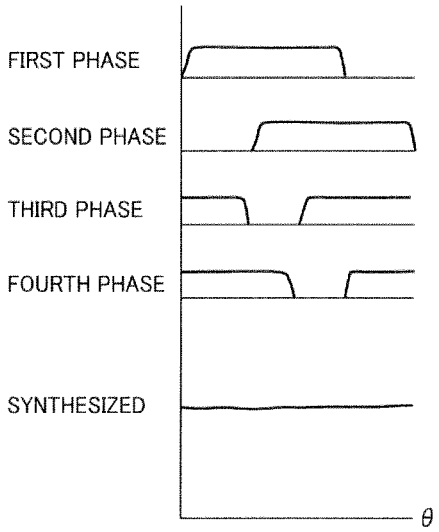
FIG. 10 a diagram showing a relationship between a powder discharge speed and a rotational angle of the bellows pump of the present invention when the bellows are multiply located.

FIG. 10 a diagram showing a relationship between a powder discharge speed and a rotational angle θ of the bellows pump 100 of the present invention when the bellows 101 are multiply located.

When four cams 130 are located at a phase difference of 90[°] which is one fourth of 360[°], a relationship between a powder discharge speed and a rotational angle θ of each of the phases ($1^{st}$ to $4^{th}$ phases) is shown in FIG. 10. A synthesized discharge speed of the toner T transferred by each of the phases and a rotational angle θ have a relationship as shown in FIG. 10, the toner T can be discharged with less pulsation at all rotational angles θ.

The toner filling apparatus 500 can precisely fill the toner container 20 with a toner when using the bellows pump 100 of the present invention.

Figure 11:
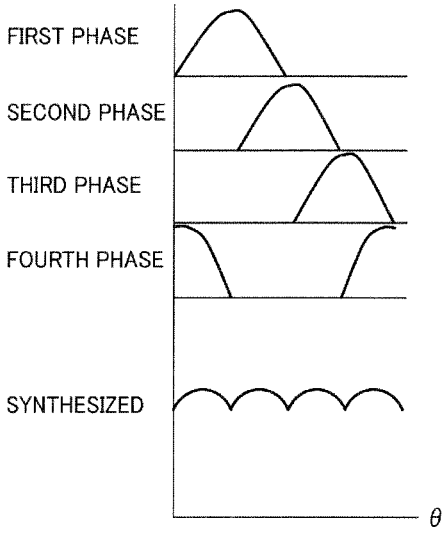
FIG. 11 a diagram showing a relationship between a powder discharge speed and a rotational angle of the conventional bellows pump when the bellows are multiply located.

FIG. 11 a diagram showing a relationship between a powder discharge speed and a rotational angle θ of the conventional bellows pump 100 when the bellows 101 are multiply located.

When four cams 130 are located at a phase difference of 90[°] which is one fourth of 360[°], a relationship between a powder discharge speed and a rotational angle θ of each of the phases ($1^{st}$ to $4^{th}$ phases) is shown in FIG. 11. A synthesized discharge speed of the toner T transferred by each of the phases and a rotational angle θ have a relationship as shown in FIG. 11, and a pulsation having a peak of discharge speed occurs at 4 points.

The toner filling apparatus 500 cannot precisely fill the toner container 20 with a toner when using the conventional bellows pump 100 because an amount of the toner T discharged varies until the toner T completely stops discharging.

The conventional bellows pump 100 has four points where a pulsation having a peak of discharge speed occurs even when the compression and expansion phases of the four bellows 101 are shifted. However, a difference between an average of transfer amount of a fluid during one cycle of reciprocation and a peak thereof can be reduced more than a bellows pump having one bellows 101 as FIG. 11 shows.

The present inventors filled the toner container 20 with 450 [g] of a toner by the toner filling apparatus 500. The conventional bellows pump 100 had a standard deviation of 0.950 [g] and the bellows pump 100 of the present invention had a standard deviation of 0.584 [g].

The above-mentioned fluid transferer of the present invention is a bellows pump, but is not limited thereto. Other reciprocating pumps such as diaphragm pumps can also be used as long as they have a volume changing part due to reciprocation.

The bellows pump 100 which is the fluid transferer of the present invention includes the bellows 101 which is a volume changing part changing is volume due to reciprocation of the reciprocating member 105. The bellows 101 expands its volume to draw the fluid toner T from the toner basket 10 at an upstream side in a transfer direction, and compresses its volume to transfer the drawn toner T downstream in the transfer direction with pressure. In the bellows pump 100, as FIGS. 1 and 2 show, the cam 130, etc. in FIG. 3 controls reciprocation of the reciprocating member 105 as a drive controller such that a time for compressing the volume of the bellows 101 is longer than a timer for expanding the volume thereof. The cam 130 in FIG. 3 can increase a time for transferring the toner T with pressure per one cycle of compression and expansion of the bellows 101. When a transfer amount of the toner T per one cycle is the same, the transfer amount of the toner T per time and a peak value thereof can be controlled because the time for transferring the toner T with pressure is long. When a transfer amount of the toner T per one cycle and a time for one cycle are the same, an average of the transfer amount of the toner T per one cycle is the same. Therefore, the peak value of the transfer amount of the toner T is controlled to control a difference between the average of the transfer amount of the toner T and the peak value of the transfer amount thereof during one cycle of the reciprocation. Thus, when the unillustrated cam shaft drive motor of the bellows pump 100 is stopped, uneven amount of the toner T fed from the bellows 101 according timing thereof until filling of the toner is stopped becomes less. Therefore, an amount of the toner T filled in the toner container 20 varies less.

Drive controllers of the bellows pump 100 in FIGS. 1 and 2 includes the unillustrated cam shaft drive motor as a rotational drive source, the cam 130, the cam follower 133, the lever 102 and the coupling rod 104. The cam 130 is rotates by drive transmission from the cam shaft drive motor, and a distance from a rotational axis to a circumferential surface of the cam changes according to a position on the circumferential surface. The cam follower 133 contacts a circumferential surface of the cam 130 and is held so as not to transfer in a rotational direction of the cam 130, and a contact point on the circumferential surface changes when the cam 130 rotates and reciprocates forward and reverse one time every time the cam 130 rotates one time. The 102 and the coupling rod 104 are reciprocation transmission member transmitting reciprocation of the cam follower 133 to the reciprocating member 105.

The cam 130 includes an area forming a compression side allocated angle α and an expansion side allocated angle β in a rotational direction. When the cam 130 has a rotational angle in a range of the compression side allocated angle α, a distance from a rotational axis to a circumferential surface becomes large in proportion to increase of the rotational angle, and the cam 130 transmits a movement to the reciprocating member 105 to compress the volume of the bellows 101. When the cam 130 has a rotational angle in a range of the expansion side allocated angle β, the distance from the rotational axis to the circumferential surface becomes small in proportion to increase of the rotational angle, and the cam 130 transmits a movement to the reciprocating member 105 to expand the volume of the bellows 101. The compression side allocated angle α of the cam 130 is larger than the expansion side allocated angle β thereof. Because of this, a drive controller controlling reciprocation of the reciprocating member 105 such that a time for compressing the volume of bellows 101 is longer than that for expanding the volume thereof can be used.

The drive controller is not limited thereto. As disclosed in Japanese published unexamined application No. 2008-075534, when a lead screw compresses and expands a bellows, a motor may have a different rotational speed in forward and reverse rotation such that an expansion time of the bellows is longer than a compression time thereof.

The bellows pump 100 in FIGS. 1 and 2 includes the compression spring 134 pressing the cam follower 133 to a circumferential surface of the cam 130 such that the cam follower 133 follows the circumferential surface thereof at the expansion side allocated angle β. This is why the drive controller transmits rotation of the cam 130 as reciprocation of the cam follower 133.

The cam 130 of the bellows pump 100 of the present invention preferably rotates at from 20 to 90 rpm. When less than 20 rpm, the toner T possibly deteriorates in fluidity because air among the toner particles deflates. When the toner T deteriorates in fluidity, the toner causes the bellows 101 and the discharge side transfer pipe 22 to be blocked inside. When faster than 90 rpm, the toner T receives more stress to agglutinate.

As FIG. 2 shows, the bellows pump 100 is formed of plural parallely-located reciprocating members 105 and bellows 101, and the drawing side transfer pipe 12 which is a flow path at an upstream side of a transfer direction and the discharge side transfer pipe 22 which is a flow path at a downstream side of the transfer direction are connected with each other. Therefore, a transfer amount of the bellows pump 100 per unit time can be increased without increasing a transfer amount of each one of the bellows per unit time. When the transfer amount of each one of the bellows 100 per unit time is not increased, the transfer amount per unit time can be increased while preventing stress to the toner T when transferred.

The bellows pump 100 in FIG. 2 has one cycle including one expansion time for expanding the volume of the bellows 101 and one compression time for compressing the volume thereof, and the expansion time and the compression time of each of four bellows 101 are the same. As FIG. 10 shows, the reciprocating member 105 corresponding to each of the bellows 101 reciprocates with a phase difference obtained by dividing one cyclic time by the number of the bellows 101. Namely, the cam 130 is located with a phase difference of 90[°] which is obtained by dividing 360[°] with 4. When the phase difference is obtained by dividing one cyclic time by the number of the bellows 101, the bellows pump 100 has almost a uniform powder discharge speed during one cycle as the bottom line (synthesized) in FIG. 10 shows.

The expansion time of the bellows 101 of the bellows pump 100 is shorter than a time of the phase difference. Even when one of the bellows 101 is in the process of expanding and is not transferring the toner, the other bellows 101 is in the process of compressing and the bellows pump 100 constantly transfers the toner T. When the expansion side allocated angle β is too small so as to shorten the expansion time, the cam follower 133 cannot follow a circumferential surface of the cam 130. Therefore, the expansion time is preferably longer than 1/12 of one cycle time, i.e., the expansion side allocated angle β is preferably larger than 30[°].

The toner filling apparatus 500 in FIG. 1 is a powder filling apparatus transferring the toner T which is a powder for filling in the toner basket 10 to the toner container 20 by a powder transferer to fill the toner container 20 with the toner T. As the powder transferer, the bellows pump 100 is used which is a fluid transferer of the present invention.

The toner filling apparatus 500 includes a basket bottom 11 as a fluidized bed feeding air to the toner T in the toner basket to increase fluidity of the toner T. The toner filling apparatus 500 further includes a valve block 140 drawing the fluidized toner T by a negative pressure made by expansion of the bellows 101 and discharging the toner T by a positive pressure made by compression thereof. The valve block 140 includes the first duckbill valve 110 and the second duckbill valve 120. The second duckbill valve 120 closes a discharge pipe when the bellows 101 expands to make a negative pressure and closes a tapered end thereof. The first duckbill valve 110 closes a drawing pipe when the bellows 101 compressed to make a positive pressure and closes a tapered end thereof.

The bellows pump 100 controls to transfer the fluidized toner T with air in one direction by negative and positive pressures made by compression and expansion of the bellows 101 and check valve effects of the two duckbill valves.

The bellows pump 100 includes the coupling rod 104 transmitting reciprocation to the reciprocating member 105 such that the bellows 101 compresses and expands, the cam 130 lifting and lowering the coupling rod 104, and the cam shaft 131 rotating the cam 130. Further, the bellows pump 100 includes an unillustrated cam shaft drive motor rotating the cam shaft 131. The cam 130 has such a shape that a distance from a center of the cam shaft 131 to a circumferential surface at the compression aide allocated angle α becomes large in proportion to a rotational angle, and the reciprocating member 105 can be pushed down at a constant speed and the volume of the bellows 101 can be compressed at a constant speed. The compression aide allocated angle α corresponding to a circumferential surface the cam follower 133 contacts when the reciprocating member 105 is pushed down is larger than the expansion side allocated angle β corresponding to a circumferential surface the cam follower 133 contacts when the reciprocating member 105 is drawn up. The toner filling apparatus 500 further includes the weigher 21 weighing the toner filled in the toner container 20. When the toner container 20 is detected to include a predetermined weight of the toner, based on the weighing result of the weigher 21, the bellows pump 100 of the present invention has less uneven transfer amount of the toner T after stopping the cam shaft drive motor. The toner filling apparatus 500 prevents the toner container 20 from being filled with uneven amount of the toner T.

When stopping the bellows pump 100 of the toner filling apparatus 500 to stop filling the toner container 20 with the toner T, it is preferable to stop the bellows pump 100 when compressing the volume of the bellows 101, but not to stop the bellows pump 100 when expanding the volume thereof. Namely, the cam shaft drive motor is preferably stopped when the cam follower 133 contacts a circumferential surface corresponding to the compression side allocated angle α of the cam 130. When the cam shaft drive motor is stopped when expanding the volume of the bellows 101, the toner T is not transferred or a little even if transferred, which is less than when the cam shaft drive motor is stopped when compressing the volume thereof and causes an uneven filled amount of the toner T. Therefore, the cam shaft drive motor is stopped when compressing the volume of the bellows 101 to prevent the toner container 20 from being filled with uneven amount of the toner T.

As a method of transferring the toner T by expanding the volume of the bellows 101 changing the volume when the reciprocating member 105 reciprocates to draw the fluid toner T from an upstream side of a transfer direction and compressing the volume of the bellows 101 to transfer the drawn toner T to a downstream side of the transfer direction with pressure, it is preferable that the reciprocating member 105 and the bellows 101 are plurally located and that the reciprocating members 105 have phase differences. The bellows pump 100 plurally includes the reciprocating member 105 and the bellows 101 and connects a flow path from the toner basket 10 at the upstream side of the transfer direction and a flow path to the toner container 20 at the downstream side thereof with each other. The bellows pump 100 has one cycle including one expansion time for expanding the volume of the bellows 101 and one compression time for compressing the volume thereof, and the expansion time and the compression time of each of the bellows 101 are the same. One cycle time is divided by the number of bellows 101 to determine a phase difference, and each of the reciprocating members 105 for each of the bellows 101 reciprocates with the phase differences. Therefore, even the bellows pump 100 including the bellows having the same expansion and compression times, as the bottom diagram in FIG. 11 shows, prevents a difference between an average and a peak value of transfer amount of the toner T during one cycle of the reciprocation.

Having now fully described the invention, it will be apparent to one of ordinary skill in the art that many changes and modifications can be made thereto without departing from the spirit and scope of the invention as set forth therein.

What is claimed is:

1. A fluid transferer, comprising:

at least one volume hanging part;

at least one reciprocating member configured to reciprocate to expand a volume of the volume changing part to draw a fluid from an upstream side of a transfer direction and compress the volume thereof to transfer the drawn fluid to a downstream side thereof with pressure; and a drive controller configured to control reciprocation of the reciprocating member such that a time for compressing the volume of the volume changing part is longer than a time for expanding the volume thereof, wherein the drive controller comprises a cam configured to rotate by drive transmission from a rotational drive source, to change a distance from a rotational axis to a circumferential surface of the cam according to a position of the circumferential surface, and wherein the cam rotates in one rotational direction to cause the reciprocating member to compress the volume of the volume changing part, and the cam rotates in an opposite rotational direction to cause the reciprocating member to expand the volume of the volume changing part.

2. The fluid transferer of claim 1, wherein the drive controller further comprises:

a cam follower configured to contact the circumferential surface of the cam, to be held so as not to travel in a rotational direction thereof, to change a contact position on the circumferential surface when the cam rotates, and to reciprocate one time every time the cam rotates one time; and a reciprocation transmitting member configured to transmit reciprocation of the cam follower to the reciprocating member, wherein the cam further comprises:

an area in which a distance from the rotational axis to the circumferential surface becomes large in proportion to increase of a rotational angle of the cam and a compression side allocated angle transmitting a motion to compress the volume of the volume changing part is formed; and an area in which a distance from the rotational axis to the circumferential surface becomes small in reverse proportion to increase of a rotational angle of the cam and a expansion side allocated angle transmitting a motion to expand the volume of the volume changing part is formed, and wherein the compression side allocated angle is larger than the expansion side allocated angle.

3. The fluid transferer of claim 2, further comprising a compression spring configured to press the cam follower to the circumferential surface of the cam such that the cam follower follows the circumferential surface of the cam at the expansion side allocated angle.

4. The fluid transferer of claim 2, wherein the cam rotates at from 20 to 90 rpm.

5. The fluid transferer of claim 1, comprising plural volume changing parts and plural reciprocating members, wherein a flow path at the upstream side of the transfer direction and a flow path at the downstream side of the transfer direction are connected with each other.

6. The fluid transferer of claim 5, wherein a total of the time for expanding the volume thereof is deemed one cyclic time, and the one cyclic is divided by the number of the volume changing parts to determine a phase difference of time, and with which the reciprocating member for each of the volume changing parts reciprocates.

7. The fluid transferer of claim 6, wherein the time for expanding the volume of each the volume changing parts is shorter than the phase difference of time and longer than 1/12 of the one cyclic time.

8. A powder filling apparatus, comprising:

a powder basket configured to include a powder;

a powder container configured to contain the powder; and a powder transferer configured to transfer the powder from the powder basket to the powder container, wherein the powder transferer is the fluid transferer according to claim 1.

9. The powder filling apparatus of claim 8, wherein the fluid transferer is stopped when compressing the volume of the volume changing part but is not stopped when expanding the volume thereof to stop filling the powder container with the powder.

10. The fluid transferor of claim 1, wherein said at least one reciprocating member is disposed between the at least one volume changing part and the cam.

11. A fluid transfer method performed by a fluid transfer apparatus, comprising:

expanding a volume of each of plural volume changing parts of the fluid transfer apparatus with each of plural reciprocating members of the fluid transfer apparatus to draw a fluid from an upstream side of a transfer direction; and compressing the volume thereof with each of the plural reciprocating members to transfer the drawn fluid to a downstream side thereof with pressure, wherein a flow path at the upstream side of the transfer direction and a flow path at the downstream side of the transfer direction are connected with each other, a time for compressing the volume of each of the volume changing parts is the same as the time for expanding the volume thereof, and a total of which is one cyclic time, and each of the reciprocating members reciprocates with a phase difference, wherein a drive controller of the fluid transfer apparatus controls reciprocation of the plural reciprocating members and comprises a cam configured to rotate by drive transmission from a rotational drive source and change a distance from a rotational axis to a circumferential surface of the cam according to a position of the circumferential surface, and wherein the cam rotates in one rotational direction to cause the reciprocating member to compress the volume of the volume changing part, and the cam rotates in an opposite rotational direction to cause the reciprocating member to expand the volume of the volume changing part.

* * * * *